US009809990B1

(12) United States Patent
Hui et al.

(10) Patent No.: US 9,809,990 B1
(45) Date of Patent: Nov. 7, 2017

(54) SWIMMING POOL CLEANING VEHICLE WITH SIDE INTAKE FLAPS AND METHOD THEREFOR

(71) Applicant: Wing-Kin Hui, Hong Kong (CN)

(72) Inventors: Wing-Kin Hui, Hong Kong (CN); Wing-Tak Hui, Hong Kong (CN); Andrew Hui, San Jose, CA (US)

(73) Assignee: COMPUROBOT TECHNOLOGY COMPANY, Dongguan (CN)

( * ) Notice: Subject to any disclaimer, the term of this patent is extended or adjusted under 35 U.S.C. 154(b) by 0 days.

(21) Appl. No.: 15/274,250

(22) Filed: Sep. 23, 2016

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654
See application file for complete search history.

(56) References Cited

U.S. PATENT DOCUMENTS

| | | | | |
|---|---|---|---|---|
| 3,675,261 | A * | 7/1972 | Burgess | E04H 4/1654 15/1.7 |
| 4,168,557 | A * | 9/1979 | Rasch | E04H 4/1654 15/1.7 |
| 5,197,158 | A * | 3/1993 | Moini | E04H 4/1654 15/1.7 |
| 6,412,133 | B1 * | 7/2002 | Erlich | E04H 4/1663 15/1.7 |
| 7,213,287 | B2 * | 5/2007 | Hui | E04H 4/1654 15/1.7 |
| 2007/0157413 | A1 * | 7/2007 | Roumagnac | E04H 4/1654 15/302 |
| 2013/0030659 | A1 * | 1/2013 | Porat | E04H 4/1654 701/49 |
| 2014/0014140 | A1 * | 1/2014 | Correa | E04H 4/1654 134/34 |

* cited by examiner

*Primary Examiner* — Randall Chin
(74) *Attorney, Agent, or Firm* — Weiss & Moy, P.C.; Jeffrey D. Moy

(57) ABSTRACT

An automated swimming pool cleaner has a housing having an inlet formed on a bottom surface thereof. At least one slot is formed in a bottom side surface of the housing. A flap is provided and is in fluid communication with the slot. A wheel is coupled to the flap. The wheel keeps a bottom surface of the flap a minimum distance above a floor/wall of a swimming pool.

19 Claims, 7 Drawing Sheets

SWIMMING POOL CLEANING VEHICLE WITH SIDE INTAKE FLAPS AND METHOD THEREFOR

TECHNICAL FIELD

The present application generally relates to a cleaning device for a swimming pool, and more specifically, to a swimming pool cleaning device that has side intake flaps which are used to increase the suction cleaning path width of the swimming pool cleaning device.

BACKGROUND

Swimming pool cleaning devices (hereinafter pool cleaners) are used for maintaining residential and commercial swimming pools in a clean and attractive condition. Pool cleaners have been developed for cleaning and/or dislodging settled debris from the floor and side wall surfaces of the swimming pool, thereby substantially reducing the need for manual vacuuming and/or brushing of the floor and side wall surfaces of the swimming pool A typical pool cleaner may include a housing and a drive member. The drive member may attach to the housing usually through a connection to a chassis. The drive member may include wheels, endless loop tracks and combinations thereof each. In the case of a belt or endless loop track, the track may wrap around the drive and/or idler wheels or rollers. The drive member may also be used to create at least a partial vacuum so that water will be encourage to enter one or more intake ports formed in the housing.

The drive member may be powered by a power source coupled to the drive member. Alternatively, the housing may be coupled to a swimming pool water filtration system by a hose. The swimming pool water filtration system may power the drive members causing the pool cleaning device to travel about within the swimming pool to dislodge and collect settled debris.

In operation, a typical pool cleaner moves along the surface of the pool. Water may flow into the one or more intake ports. Depending on the type of pool cleaning system, the water may flow through a filter bag stored within the housing and exit out the housing through an outlet port. Alternatively, the water/debris which enters the one or more inlet ports may exit out of the housing to the swimming pool water filtration system.

A typical pool cleaner generally moves in a randomly pattern along the floor and/or walls of the swimming pool during cleaning. In general, the suction cleaning path of the pool cleaner is limited to the width of pool cleaner. While smaller pool cleaners may be more maneuverable, the smaller suction cleaning path correlates to the pool cleaner needing a substantial amount of time to clean the entire pool surface.

However, increasing the width of the pool cleaner to increase the suction cleaning path may limit the maneuverability of the pool cleaner and the ability of the pool cleaner to get into and clean certain indentations/bends/transitional areas formed within the swimming pool. Further, increasing the width of the pool cleaner also likely increases the weight of the pool cleaner. Heavier pool cleaners generally require more power/suction to move the drive members. Heavier pool cleaners may also be difficult for owners to lift in and out of the swimming pool.

Therefore, it would be desirable to provide a system and method that overcomes the above.

SUMMARY

In accordance with one embodiment, an automated swimming pool cleaner is disclosed. The automated swimming pool cleaner has a housing having an inlet formed on a bottom surface thereof. At least one slot is formed in a bottom side surface of the housing. A flap is in fluid communication with the slot. A wheel is coupled to the flap. The wheel keeps a bottom surface of the flap a minimum distance above a floor/wall of a swimming pool.

In accordance with one embodiment, an automated swimming pool cleaner is disclosed. The automated pool cleaner has a housing having an inlet formed on a bottom surface thereof. At least one slot formed in a bottom side surface of the housing. A flap is in fluid communication with the slot, the flap extends out and away from the slot. An interior of the flap is angled downward so that a distance above a bottom surface of the flap decreases as the flap extends outward away from the housing. A wheel is coupled to the flap. The wheel keeps a bottom surface of the flap a minimum distance above a floor/wall of a swimming pool.

In accordance with one embodiment, an automated swimming pool cleaner is disclosed. The automated swimming pool cleaner has a housing having an inlet formed on a bottom surface thereof. At least one slot is formed in a bottom side surface of the housing. A flap is provided and is in fluid communication with the slot. The flap extends out and away from the slot in a fan configuration. An interior of the flap is angled downward so that a distance between a top surface of the interior of the flap and a bottom surface of the flap decreases as the flap extends away from the housing. An inlet channel extends from the flap. The inlet channel is configured to slide within the slot. A wheel is coupled to the flap. The wheel keeps a bottom surface of the flap a minimum distance above a floor/wall of a swimming pool. A wheel well is formed within an interior of the flap wherein the wheel is rotatably coupled within the wheel well.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure Embodiments of the exemplary system and method provide an automated swimming pool cleaner (hereinafter pool cleaner) that has side intake flaps. The side intake flaps may be used to increase the suction cleaning path width of the pool cleaner.

Figure 1:
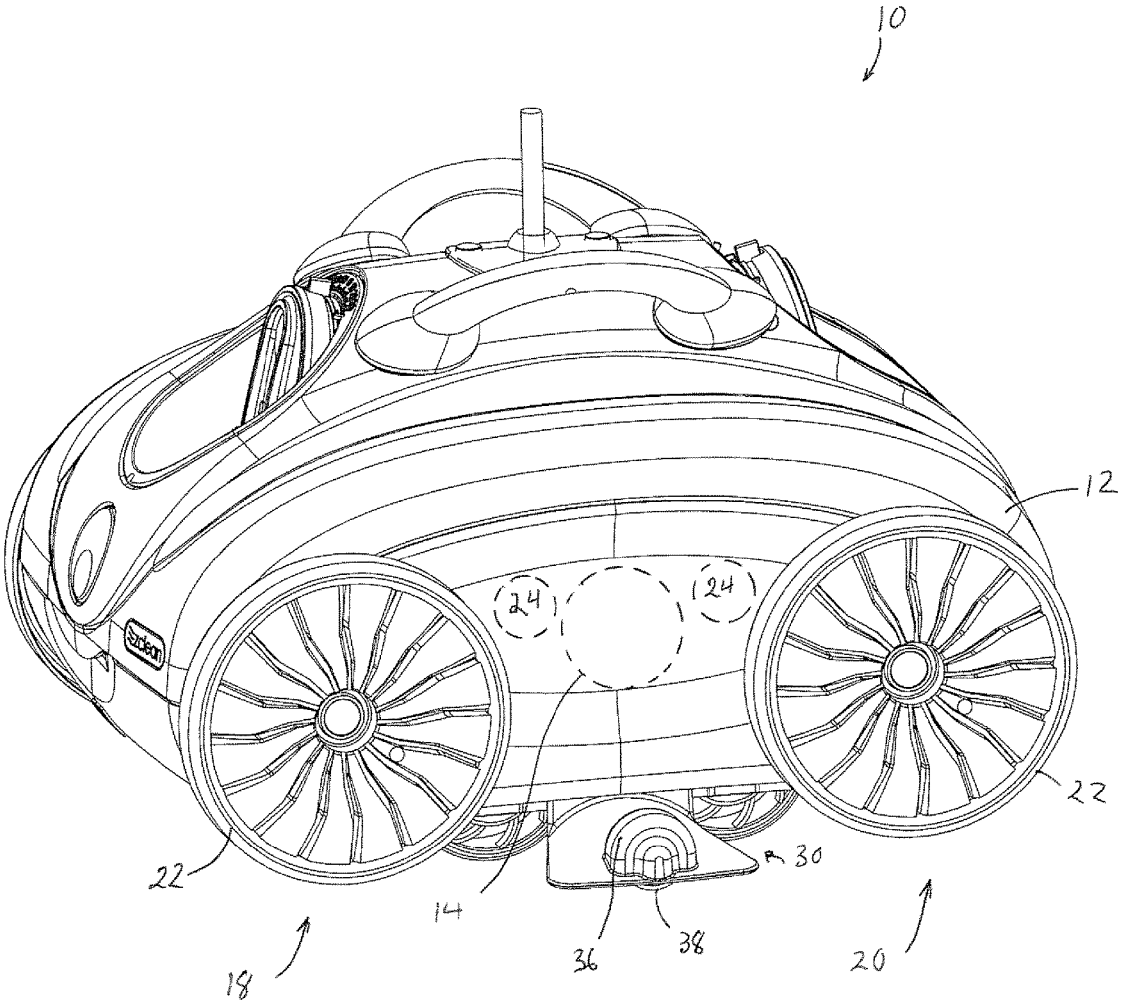
FIG. 1 is a prospective view of a swimming pool cleaning device with intake flaps in accordance with one aspect of the present application.
Figure 2:
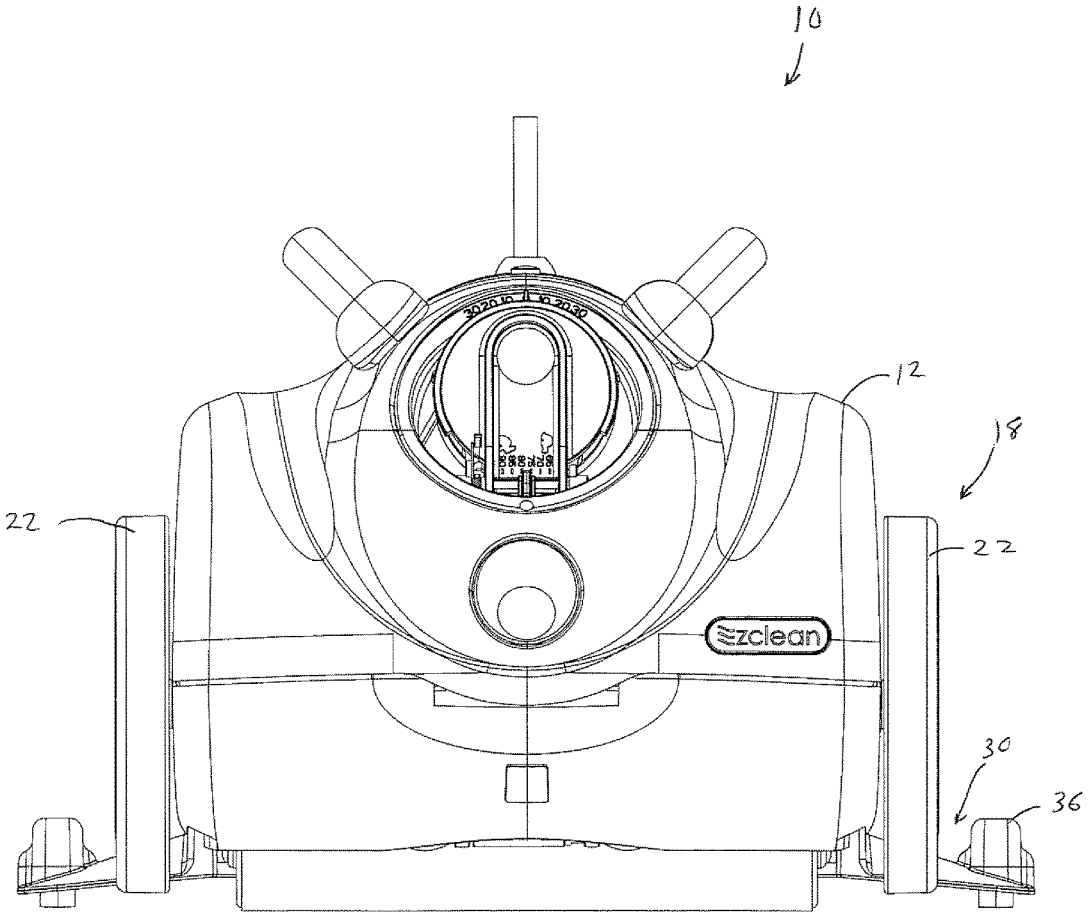
FIG. 2 is a front view of a swimming pool cleaning device of FIG. 1 in accordance with one aspect of the present application.
Figure 3:
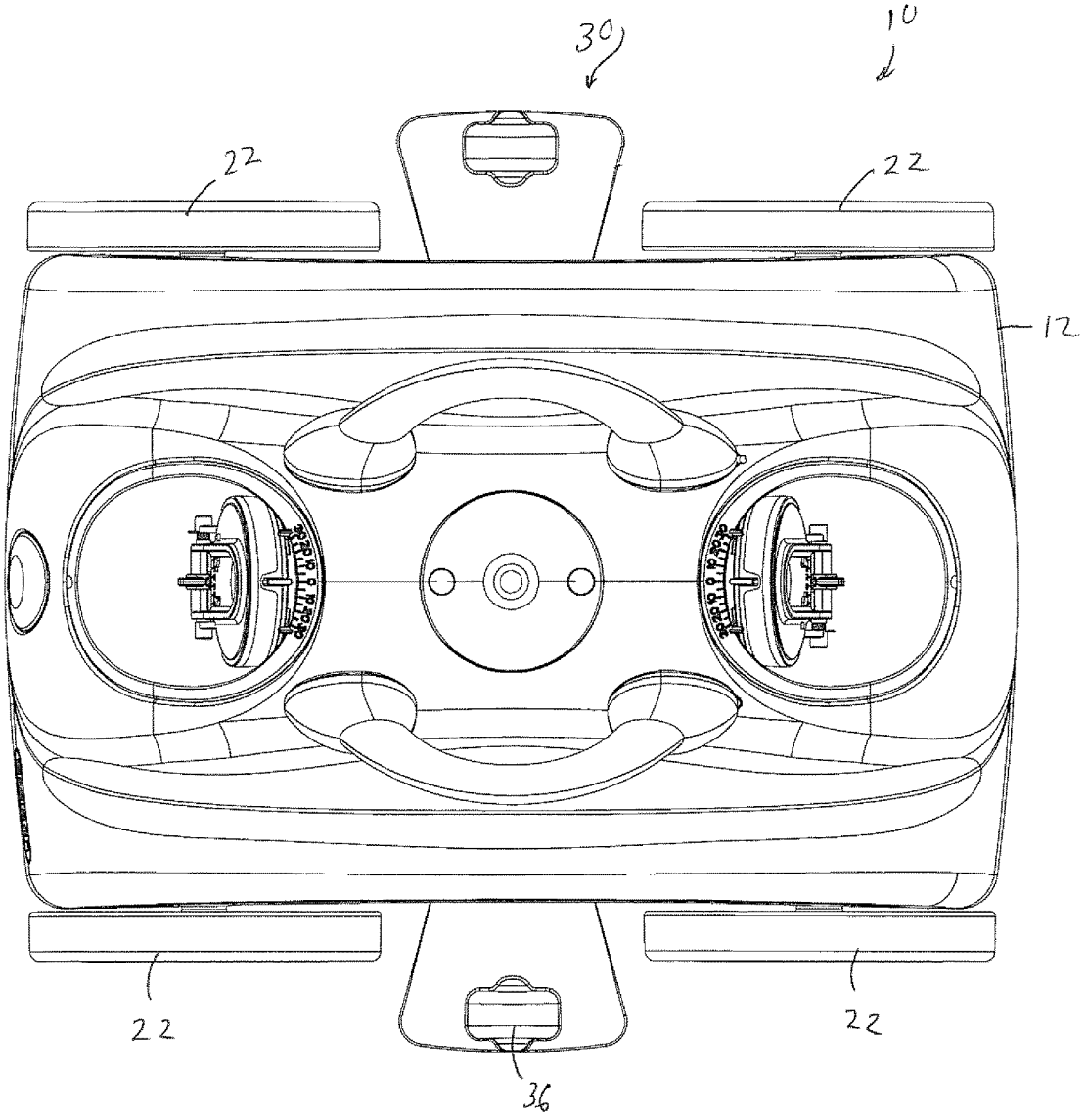
FIG. 3 is a is a top perspective view of the swimming pool cleaning device of FIG. 1 in accordance with one aspect of the present application.
Figure 4:
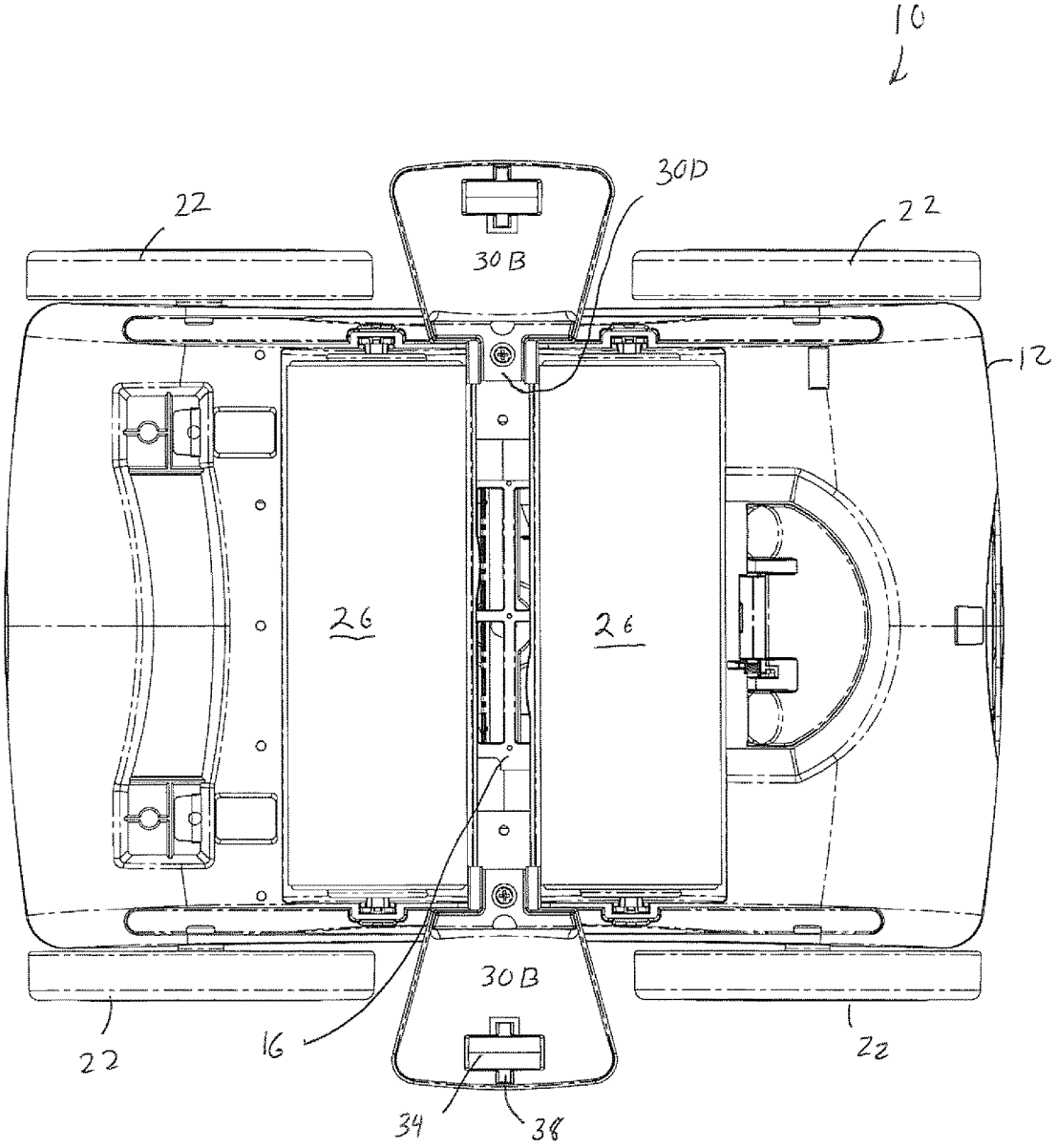
FIG. 4 is a bottom view of the swimming pool cleaning device of FIG. 1 in accordance with one aspect of the present application.
Figure 5:
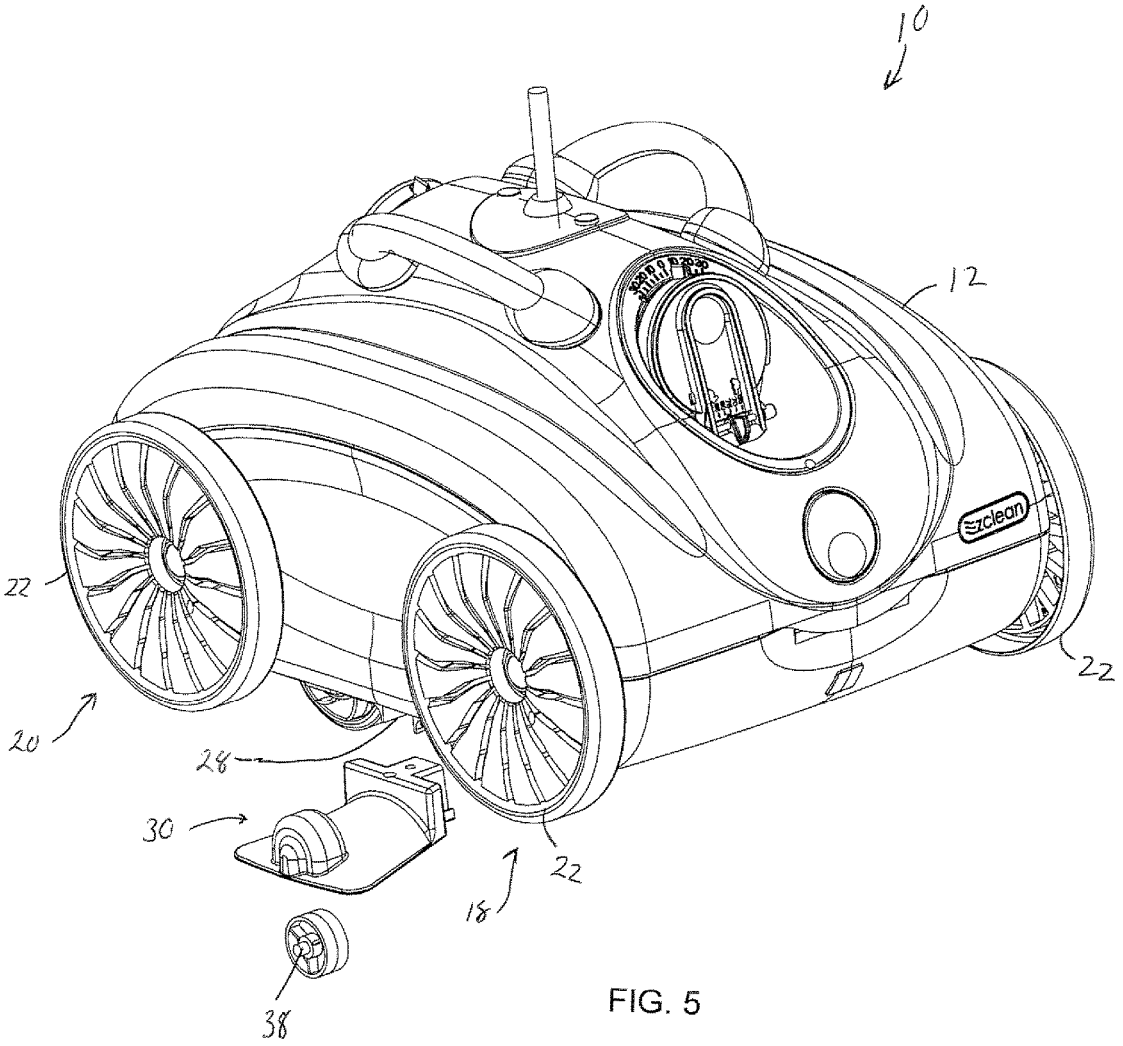
FIG. 5 is an exploded perspective view of the swimming pool cleaning device of FIG. 1 in accordance with one aspect of the present application.
Figure 6:
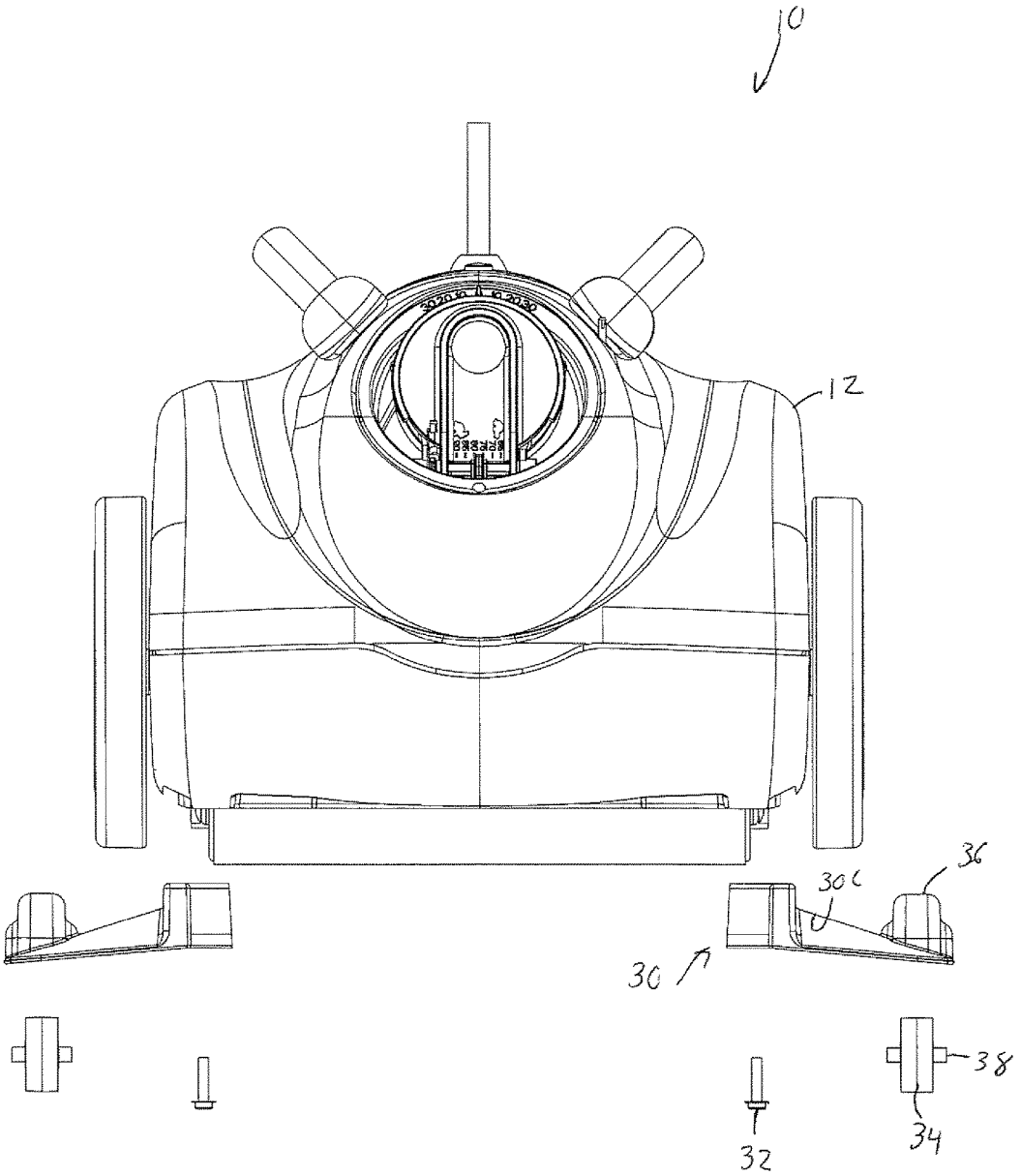
FIG. 6 is an exploded front view of the swimming pool cleaning device of FIG. 1 in accordance with one aspect of the present application.
Figure 7:
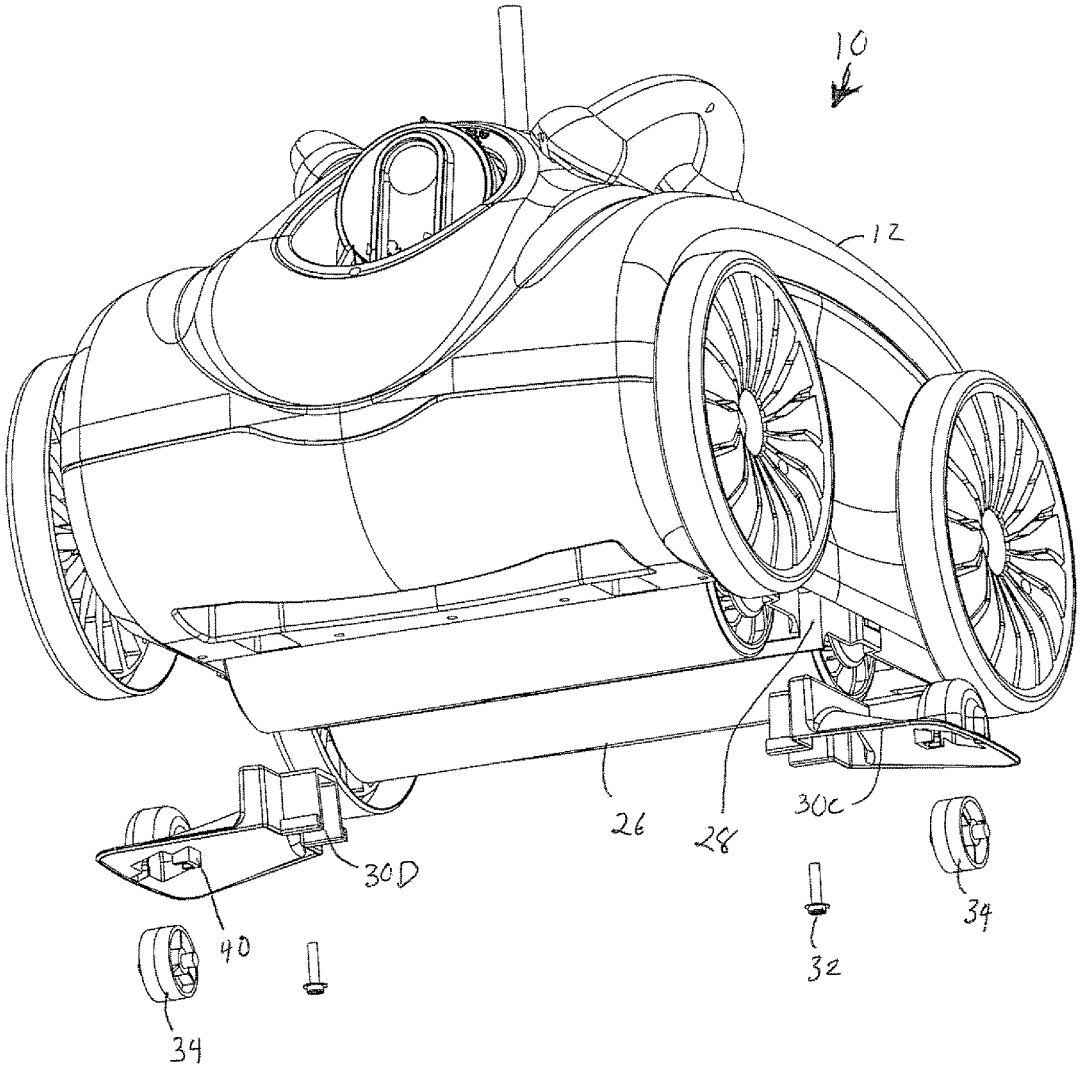
FIG. 7 is an exploded elevated bottom view of the swimming pool cleaning device of FIG. 1 in accordance with one aspect of the present application.

Referring to FIGS. 1-7, an automated swimming pool cleaner 10 (hereinafter pool cleaner 10) may be seen. The pool cleaner 10 may have a housing 12. Located within an interior of the housing 12 may be a pump 14. The pump 14 may be used to create a vacuum. When the pump 14 is active, the pump 14 creates a vacuum that causes dirt and debris to be sucked into the housing 12 through one or more an intakes 16. It should be noted that the pool cleaner 10 could also be coupled to a pool filtration system. The pool filtration system may be used to generate the vacuum within the interior of the housing 12 to suck up dirt and debris on a floor/wall of the swimming pool.

The pool cleaner 10 may have a first rolling mechanism 18 located in a bottom area of a front section of the housing 12. A second rolling mechanism 20 may be located in a bottom area of a rear section of the housing 12. The first rolling mechanism 18 and the second rolling mechanism 20 may each be formed of a pair of wheels 22, a roller, a combination of the pair of wheels 22 and the roller or similar rolling devices. The pump 14 may be used to power a drive system 24. The drive system 24 may be used to rotate one or more of the first rolling mechanism 18 and/or second rolling mechanism 20. Alternatively, the vacuum generated by pool filtration system may be used to power the drive system 24.

One or more rolling brushes 26 may be located in the bottom area of the housing 12 between the first rolling mechanism 18 and the second rolling mechanism 20. The rolling brushes 26 may be used to stir up and encourage dirt and debris to enter intakes 16 in the housing 12. The drive system 24 may be used to rotate the rolling brushes 26.

One or more intakes 16 may be formed in a bottom section of the housing 12. In the embodiments shown in the FIGS. 1-7, the intake 16 may be formed in a bottom central area of the housing 12. The intake 16 may run along the width of the bottom section of the housing 12. When the pump 14 and/or the pool filtration system creates a vacuum within the housing 12, water as well as any dirt and/or debris may be drawn into the intake 16.

One or more slots 28 may be formed in bottom side surfaces of the housing 12. The slots 28 may be in fluid communication with the interior of the housing 12. In accordance with one embodiment, the slots 28 may extend into and be in fluid communication with the intake 16 which may run along the width of the bottom section of the housing 12. When the pump 14 and/or the pool filtration system creates a vacuum within the housing 12, water as well as any dirt and/or debris may be drawn into the slots 28 and/or intake 16.

Water tends to flow along a least resistant path. Thus, too many slots 28 connected to the vacuum formed in the interior of the housing 12 may make it difficult to maintain a balanced flow. This may result in one or more slots 28 and/or intakes 16 to have a partial loss of suction.

To increase the cleaning path width of the pool cleaner 10 to that greater that a width of the housing 12 but without sacrificing the suction power and reduce degree of partial vacuum, one or more flaps 30 may be coupled to the housing 12. The flap 30 may be formed of a light-weight but sturdy material. In accordance with one embodiment, the flaps 30 may be formed of Polyvinyl chloride (PVC) or other types of plastic. The flap 30 may be configured to force water to go under the flap 30 before it enters the slot 28. By doing so, the water forced under the flap 30 may carry the dirt and other debris under the flap 30 and effectively increase the suction cleaning path width of the pool cleaner 10.

In accordance with one embodiment, the flap 30 may be configured to diverge outward from the slot 28. Thus, the flap 30 may be fan shaped when looking downward on the flap 30 such that a width of the flap 30 increases as the flap 30 extends further away from the housing 12 of the pool cleaner 10.

The flap 30 has an open bottom surface 30A exposing a hollow interior 30B of the flap 30. The interior 30B of the flap 30 may be angled downward. In accordance with one embodiment, the interior 30B of the flap 30 may be angled downward such that a distance above the bottom surface 30A decreases as the flap 30 extends further away from the pool cleaner 10. Thus, the interior 30B of the flap 30 may be wedge shaped wherein the distance between a top surface 30C of the interior 30B and the bottom surface 30A decreases as the flap 30 extends further away from the pool cleaner 10. This wedge shape configuration may help to funnel water towards the slot 28 thereby helping to prevent any partial loss of suction within the housing 12.

Each flap 30 may be attached to the housing 12. In accordance with one embodiment, the flap 30 may have an inlet channel 30D. The inlet channel 30D may extend out from the flap 30. The inlet channel 30D may be dimensioned to be inserted into a slot 28 thereby allowing water to flow under the flap 30 and into the slot 28. The above is given as an example and should not be seen in a limiting manner. The flap 30 may be attached to the housing 12 in other manners without departing from the spirit and scope of the present invention. For example, connecting devices 32 such as rivets, screws and similar devices may be used to secure the flap 30 to the housing 12. The connecting devices 32 may be used alone or in combination with the slot 28. As may be seen in the FIGs., the connecting devices 32 may be used to further secure the inlet channel 30D within the slot 28.

A wheel 34 may be rotatably coupled to the flap 30. The wheel 34 may be used to keep the bottom surface 30A of the flap 30 a minimum distance above the floor/wall of the swimming pool. In accordance with one embodiment, a wheel well 36 may be formed in the interior 30B of the flap 30. The wheel well 36 may be an indentation formed in the interior 30B of the flap 30. In the embodiment shown, the wheel well 36 may be formed in the distal end of the interior 30B of the flap 30.

An axle assembly 38 may be used to rotatably couple the wheel 34 to the flap 30. In the embodiment shown in the FIGs., the axle assembly 38 may be rotatably secured within the wheel well 36. A pair of grooves 40 may be formed within wheel well 36. The grooves 40 may house the axle assembly 38 and allow the axle assembly and hence the wheel 34 to rotate freely within the wheel hub 36.

In operation, as the pool cleaner 10 moves along the swimming pool floor/wall, the wheel 34 may keep the bottom surface 30A of the flap 30 a minimum distance above the floor/wall of the swimming pool. Since the wheel 34 may keep the bottom surface 30A of the flap 30 above the floor/wall of the swimming pool, water may be force to go under the flap 30 before it enters the slot 28. By doing so, the water forced under the flap 30 may carry the dirt and other debris under the flap 30 with it and effectively increase the suction cleaning path width of the pool cleaner 10. Thus, the flap 30 may improve cleaning efficiency by increasing cleaning path width but without sacrificing the suction power and/or a partial loss of suction. The flap 30 may allow for balanced suction through the one or more slots 28 and intakes 16.

The foregoing description is illustrative of particular embodiments of the application, but is not meant to be a limitation upon the practice thereof. The following claims, including all equivalents thereof, are intended to define the scope of the application.

What is claimed is:

1. An automated swimming pool cleaner comprising:

a housing having an inlet formed on a bottom surface thereof;

at least one slot formed in a bottom side surface of the housing;

a flap in fluid communication with the slot, wherein the flap diverges outward from the slot and is fan shaped; and a wheel coupled to the flap, the wheel keeping a bottom surface of the flap a minimum distance above a floor/wall of a swimming pool.

2. The automated swimming pool cleaner in accordance with claim 1, wherein an interior of the flap is angled downward, wherein a distance above a bottom surface of the flap decreases as the flap extends outward away from the housing.

3. The automated swimming pool cleaner in accordance with claim 1, wherein an interior of the flap is angled downward, wherein a distance between a top surface of the interior of the flap and a bottom surface flap decreases as the flap extends away from the housing.

4. The automated swimming pool cleaner in accordance with claim 1, comprising a wheel well formed within an interior of the flap, the wheel rotatably coupled within the wheel well.

5. The automated swimming pool cleaner in accordance with claim 1, comprising:

a wheel well formed within an interior of the flap;

a pair of grooves formed within the wheel well; and an axle assembly coupled to the wheel, the axle assembly held within the pair of grooves.

6. The automated swimming pool cleaner in accordance with claim 1, comprising an inlet channel extending from the flap, the inlet channel configured to slide within the slot.

7. The automated swimming pool cleaner in accordance with claim 6, comprising connecting devices securing the inlet channel within the slot.

8. The automated swimming pool cleaner in accordance with claim 1, comprising connecting devices securing the flap to the housing.

9. An automated swimming pool cleaner comprising:

a housing having an inlet formed on a bottom surface thereof;

at least one slot formed in a bottom side surface of the housing;

a flap in fluid communication with the slot, the flap extending out and away from the slot, an interior of the flap angled downward so a distance above a bottom surface of the flap decreases as the flap extends outward away from the housing; and a wheel coupled to the flap, the wheel keeping a bottom surface of the flap a minimum distance above a floor/wall of a swimming pool.

10. The automated swimming pool cleaner in accordance with claim 9, wherein the flap is fan shaped.

11. The automated swimming pool cleaner in accordance with claim 9, wherein a distance between a top surface of the interior of the flap and a bottom surface of the flap decreases as the flap extends away from the housing.

12. The automated swimming pool cleaner in accordance with claim 9, comprising a wheel well formed within an interior of the flap, the wheel rotatably coupled within the wheel well.

13. The automated swimming pool cleaner in accordance with claim 12, comprising:

a pair of grooves formed within the wheel well; and an axle assembly coupled to the wheel, the axle assembly held within the pair of grooves.

14. The automated swimming pool cleaner in accordance with claim 9, comprising an inlet channel extending from the flap, the inlet channel configured to slide within the slot.

15. The automated swimming pool cleaner in accordance with claim 14, comprising connecting devices securing the inlet channel within the slot.

16. An automated swimming pool cleaner comprising:

a housing having an inlet formed on a bottom surface thereof;

at least one slot formed in a bottom side surface of the housing;

a flap in fluid communication with the slot, the flap extending out and away from the slot in a fan configuration, an interior of the flap angled downward so a distance between a top surface of the interior of the flap and a bottom surface of the flap decreases as the flap extends away from the housing;

an inlet channel extending from the flap, the inlet channel configured to slide within the slot;

a wheel coupled to the flap, the wheel keeping a bottom surface of the flap a minimum distance above a floor/wall of a swimming pool a wheel well formed within an interior of the flap, the wheel rotatably coupled within the wheel well.

17. The automated swimming pool cleaner in accordance with claim 16, comprising:

a pair of grooves formed within the wheel well; and an axle assembly coupled to the wheel, the axle assembly held within the pair of grooves.

18. The automated swimming pool cleaner in accordance with claim 16, comprising connecting devices securing the flap to the housing.

19. The automated swimming pool cleaner in accordance with claim 16, comprising connecting devices securing the inlet channel within the slot.

* * * * *